US011225957B2

(12) United States Patent
Tramposch

(10) Patent No.: US 11,225,957 B2
(45) Date of Patent: Jan. 18, 2022

(54) LUBRICANT RECEPTACLE FOR A REFRIGERANT COMPRESSOR

(71) Applicant: Secop GmbH, Flensburg (DE)

(72) Inventor: Andreas Tramposch, Seiersberg (AT)

(73) Assignee: Secop GmbH, Flensburg (DE)

( * ) Notice: Subject to any disclaimer, the term of this patent is extended or adjusted under 35 U.S.C. 154(b) by 0 days.

(21) Appl. No.: 17/276,532

(22) PCT Filed: Sep. 27, 2019

(86) PCT No.: PCT/EP2019/076159
§ 371 (c)(1),
(2) Date: Mar. 16, 2021

(87) PCT Pub. No.: WO2020/064998
PCT Pub. Date: Apr. 2, 2020

(65) Prior Publication Data

US 2021/0310471 A1 Oct. 7, 2021

(30) Foreign Application Priority Data

Sep. 28, 2018 (EP) ..... 18197570

(51) Int. Cl.
*F04B 39/02* (2006.01)
*F01M 1/02* (2006.01)

(52) U.S. Cl.
CPC ..... *F04B 39/0261* (2013.01); *F01M 1/02* (2013.01); *F04B 39/0253* (2013.01); *F01M 2001/0238* (2013.01); *F01M 2001/0269* (2013.01)

(58) Field of Classification Search
CPC ..... F04B 39/0261; F04B 37/14; F01M 1/02; F01M 2001/0238; F01M 2001/0269
See application file for complete search history.

(56) References Cited

U.S. PATENT DOCUMENTS 6,450,785 B1 * 9/2002 Dellby ..... F04B 39/0261 184/6.16
8,202,067 B2 * 6/2012 Klein ..... F04B 39/0246 417/410.3

(Continued)

FOREIGN PATENT DOCUMENTS

AT 15828 U1 7/2018
WO 2004/081383 A1 9/2004

OTHER PUBLICATIONS

International Search Report in PCT/EP2019/076159, dated Nov. 4, 2019.

*Primary Examiner* — Michael R Mansen
*Assistant Examiner* — Mark K Buse
(74) *Attorney, Agent, or Firm* — Collard & Roe, P.C.

(57) ABSTRACT

A lubricant holder for vertical conveying of lubricant using a crankshaft of a coolant compressor includes a sleeve element having a clear cross-section delimited by an inside wall, which cross-section extends along a longitudinal axis, from an upper end to a lower end, an inner element that has a mantle surface that extends along a longitudinal axis of the inner element, from a lower end to an upper end, wherein in an operating state the inner element is arranged within the clear cross-section with its mantle surface, at least in certain areas. At least one groove of the inside wall and/or of the mantle surface, which groove runs in spiral shape, has a varying angle of inclination, which preferably increases from the lower end to the upper end of the mantle surface.

12 Claims, 2 Drawing Sheets

(56) References Cited

U.S. PATENT DOCUMENTS

| | | | | |
|---|---|---|---|---|
| 10,844,759 | B2 * | 11/2020 | Sacomori | F04B 39/0246 |
| 2002/0170778 | A1 | 11/2002 | Kim | |
| 2002/0172607 | A1 * | 11/2002 | Kim | F04B 39/0261 417/366 |
| 2003/0010573 | A1 * | 1/2003 | Kueon | F04B 39/0253 184/6.16 |
| 2006/0013706 | A1 | 1/2006 | Ishida et al. | |
| 2010/0074771 | A1 * | 3/2010 | Klein | F04B 39/0261 417/410.1 |
| 2018/0347556 | A1 * | 12/2018 | Tamura | F04B 39/0261 |
| 2019/0368481 | A1 | 12/2019 | Treichl et al. | |

* cited by examiner

Fig. 1
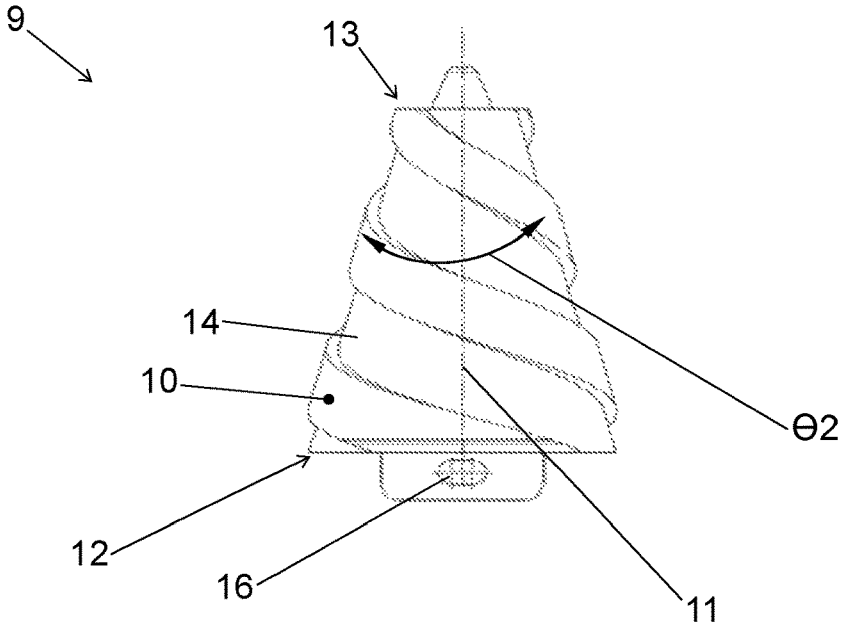
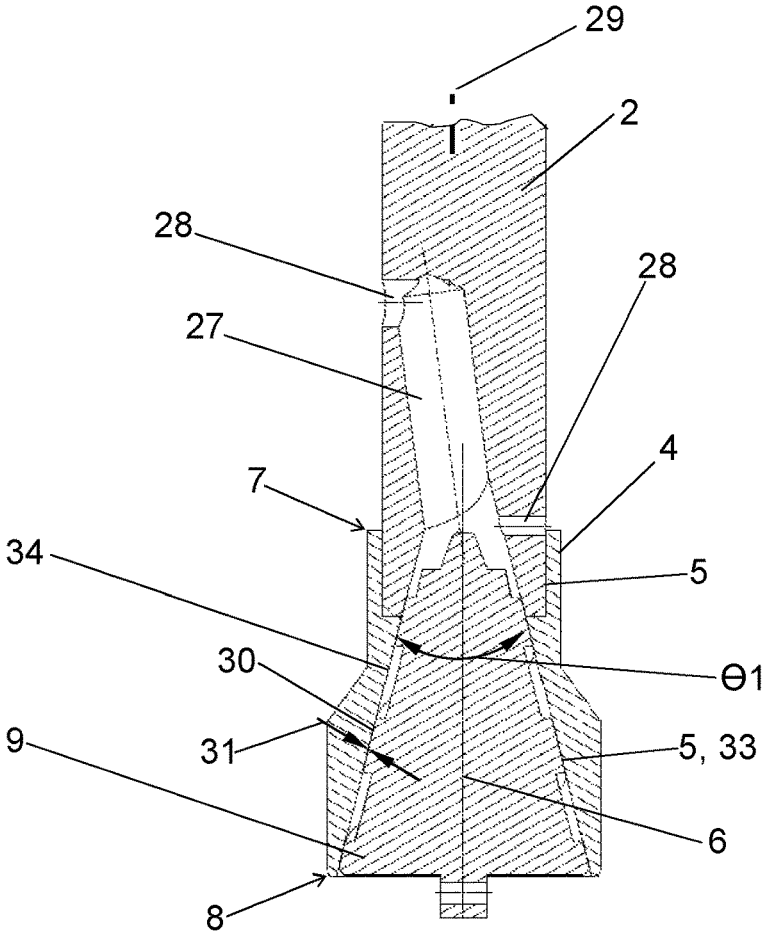
Fig. 2

LUBRICANT RECEPTACLE FOR A REFRIGERANT COMPRESSOR

CROSS REFERENCE TO RELATED APPLICATIONS

This application is the National Stage of PCT/EP2019/076159 filed on Sep. 27, 2019, which claims priority under 35 U.S.C. § 119 of European Application No. 18197570.7 filed on Sep. 28, 2018, the disclosure of which is incorporated by reference. The international application under PCT article 21(2) was not published in English.

FIELD OF THE INVENTION

The present invention relates to a lubricant holder for vertical conveying of lubricant by means of a crankshaft of a coolant compressor, comprising a sleeve element having a clear cross-section delimited by an inside wall, which cross-section extends along a longitudinal axis of the sleeve element, from an upper end to a lower end of the sleeve element, the lubricant holder furthermore comprising an inner element that has a mantle surface that extends along a longitudinal axis of the inner element, from a lower end to an upper end, wherein in an operating state of the lubricant holder

- the inner element is arranged within the clear cross-section of the sleeve element with its mantle surface, at least in certain areas,
- viewed in the direction from the lower end to the upper end of the sleeve element, the lower end of the mantle surface is disposed in front of its upper end, and
- the inner element and the sleeve element can be rotated relative to one another about the longitudinal axis of the sleeve element and/or the longitudinal axis of the inner element, wherein the clear cross-section narrows from the lower end to the upper end of the sleeve element, at least in a holding segment intended for holding the inner element, wherein the inner element narrows in the region of the mantle surface, from the lower end to the upper end of the mantle surface, and wherein the inside wall and/or the mantle surface has/have at least one groove that runs in the manner of a spiral.

STATE OF THE ART

In the case of coolant compressors having a compressor housing that can be hermetically encapsulated, an electrical drive unit arranged in a housing interior of the compressor housing, comprising a rotor and a stator, a crankshaft connected with the rotor in torque-proof manner, as well as a piston/cylinder unit arranged in the housing interior, which unit comprises a piston movably mounted in a cylinder of the piston/cylinder unit, which piston can be driven by the crankshaft for compression of coolant, ensuring sufficient lubrication of all the moving components is of particular importance. For this purpose, it can be provided that lubricant that collects in a lubricant sump that covers a bottom region of the compressor housing is conveyed in the direction of the cylinder by way of the crankshaft.

For this purpose, a sleeve-shaped lubricant holder is often provided, which holder is connected with the crankshaft in torque-proof manner and arranged coaxial to it, and projects into the lubricant sump with an end section. Lubricant that has penetrated out of the lubricant sump into a cylindrical holding section of the lubricant holder through an entry opening is forced into a paraboloid shape due to the rotation of the lubricant holder—which is brought about by the rotation of the crankshaft—wherein the paraboloid forms along the inside wall of the lubricant holder and along an inside wall of the crankshaft—which is structured to be hollow or is provided with a bore. Such a lubricant holder is known from AT 15828 U1, for example.

A maximal rising height to which the lubricant contained in the holding section of the lubricant holder can be raised in this manner is achieved in the region of the clear inside diameter of the crankshaft or of the bore, and depends on the square of the speed of rotation of the lubricant holder as well as on the square of the clear inside radius of the crankshaft or of the lubricant holder. The lubricant can then exit from the crankshaft to locations to be lubricated, by way of at least one exit bore.

In the case of a corresponding selection of the production parameters (for example clear inside radius of the crankshaft, height of the exit bores) and process parameters (for example speed of rotation of the crankshaft, viscosity of the lubricant) it is therefore possible to convey the lubricant from the bottom of the compressor housing, by means of the lubricant holder, by way of the crankshaft of the compressor, to the contact locations of the main bearing of the crankshaft, the crankpin, and the connecting rod of the coolant compressor.

In practice, nowadays compressors having a variable speed of rotation are increasingly being used—in contrast to conventional compressors having a fixed speed of rotation, which merely have two states, namely speed of rotation zero and a working speed of rotation of typically 3000 $min^{-1}$. In the case of compressors having a variable speed of rotation, very low speeds of rotation—typically minimally 800 $min^{-1}$—are regularly achieved in practice, as a function of a demanded cooling output. Because the rising height depends quadratically on the speed of rotation or on the rpm, low speeds of rotation represent a great problem for reliable lubrication.

Attempts to improve the conveying performance by means of an inner element have not proven to be satisfactory until now. In this regard, the cylindrical holding section is structured to be open at the bottom and the inner element, which is also structured to be cylindrical, is arranged in the holding section, so that a gap occurs between a mantle surface of the inner element and the inside wall of the holding section. In this regard, the inner element is essentially fixed in place, typically by means of being tied in with the stator. The inner element typically has a spiral-shaped groove that runs from bottom to top on its mantle surface, which groove promotes conveying of the lubricant. The inner element must have a sufficiently great radius so that the speed of rotation or tangential speed and thereby the centrifugal force, acting on the lubricant, that can be achieved is great enough, in the region of the mantle surface, so as to achieve good conveying performance even at low speeds of rotation. On the other hand, such large radii have an abrupt structural transition and thereby bring about an abrupt pressure drop between the inner element and the bore in the crankshaft, and this disadvantageously reduces the lubricant flow. It is true that lower diameters of the inner element reduce the pressure drop, but they do not produce sufficiently great centrifugal forces at low speeds of rotation.

Another disadvantage of known solution approaches using inner elements is that the width of the gap between the inner element and the inside wall of the holding section is critical.

Fundamentally, a smaller gap would tendentially result in better conveying performance. However, the gap cannot be made too small, due to the viscosity of the lubricant, since otherwise friction losses would lower the degree of effectiveness. In other words, the selection of the gap width must take place as the best possible compromise, taking these aspects into consideration. In practice, however, it has been shown that as a function of the precise operating parameters of the coolant compressor as well as the thermal expansion of the lubricant, on the one hand, and the lubricant holder with its inner element, on the other hand, the gap width (as well as the viscosity of the lubricant) is not stable, but rather changes. As a result, undesirable great variations in the conveying performance occur, and this brings with it the risk of overly low conveying performance and thereby accompanying consequential damage, in particular at low speeds of rotation.

An oil pump for a cooling compressor is known from US 2010/074771, comprising a sleeve having an inner surface and an upper section that is attached to a crankshaft and to a rotor, and a lower section, the lower end of which is immersed in cooling oil. Furthermore, the oil pump comprises an elongated pump body, which is arranged within the inner surface of the sleeve. The rotational relative movement between the sleeve and the pump body allows oil to flow upward. The sleeve and the pump body each have a conical profile. The inside surface of the sleeve has a helical groove.

TASK OF THE INVENTION

It is therefore the task of the present invention to make available a lubricant holder that avoids the disadvantages described above and guarantees reliable lubrication even at low speeds of rotation, as they regularly occur in practice, in particular, in compressors having a variable speed of rotation.

PRESENTATION OF THE INVENTION

To accomplish the task stated above, it is provided, in the case of a lubricant holder for vertical conveying of lubricant by means of a crankshaft of a coolant compressor, comprising a sleeve element having a clear cross-section delimited by an inside wall, which cross-section extends along a longitudinal axis of the sleeve element, from an upper end to a lower end of the sleeve element, the lubricant holder furthermore comprising an inner element that has a mantle surface that extends along a longitudinal axis of the inner element, from a lower end to an upper end, wherein in an operating state of the lubricant holder

- the inner element is arranged within the clear cross-section of the sleeve element with its mantle surface, at least in certain areas,
- viewed in the direction from the lower end to the upper end of the sleeve element, the lower end of the mantle surface is disposed in front of its upper end, and
- the inner element and the sleeve element can be rotated relative to one another about the longitudinal axis of the sleeve element and/or the longitudinal axis of the inner element, that the clear cross-section narrows from the lower end to the upper end of the sleeve element, at least in a holding segment intended for holding the inner element, and that the inner element narrows in the region of the mantle surface, from the lower end to the upper end of the mantle surface.

Since only the relative rotation of the sleeve element and the inner element relative to one another is important, the inner element can be connected with the crankshaft in torque-proof manner, for example, and the sleeve element can be fixed in place rotationally—except for slight angles of twist that can be ignored. The crankshaft rotates during operation of the compressor, and the inner element then does so accordingly, whereas the sleeve element does not rotate.

Alternately, the sleeve element can be connected with the crankshaft in torque-proof manner, and the inner element can be fixed in place rotationally—except for slight angles of twist that can be ignored.

A torque-proof connection between the inner element or the sleeve element and the crankshaft can fundamentally take place direction or indirectly, i.e. with the intermediary of at least one further element such as, for example, a gasket, a fastening element, etc.

The sleeve element can be connected with the crankshaft in the region of its upper end, in particular. It would be conceivable, for example, that the sleeve element is pushed onto the crankshaft in the region of the upper end with its clear cross-section, and held on the crankshaft by means of a press fit, for example. For this purpose, it can be provided that the clear cross-section widens again in the region of the upper end, as compared with the narrowing that is present in the holding segment, so as to be able to hold the crankshaft.

For the sake of good order, it is being stated that it is not precluded that the sleeve element in turn is a part or section of a larger element. However, the clear section extends over this part or section, i.e. over the sleeve element, in any case.

According to what has been stated above, the sleeve element and the inner element are designed in such a manner that in the operating state, the inner element is disposed, at least in certain areas, with its mantle surface, within the clear cross-section of the sleeve element. This means that the inner element is held in the holding segment, at least in certain areas.

According to what has been stated above, the sleeve element and the inner element are designed in such a manner that in the operating state, viewed in the direction from the lower end to the upper end of the sleeve element, the lower end of the mantle surface is arranged in front of its upper end. This means that the holding segment of the clear cross-section and the inner element, particularly its mantle surface, are oriented in at least approximately the same manner. In practice, in the case of use in a coolant compressor that is in operation, in this connection the result occurs that the lower ends of the sleeve element and of the mantle surface are arranged below the upper ends of the sleeve element and of the mantle surface in the vertical direction.

Preferably, in this regard the cross-section of the inner element or the geometry of the inner element is adapted, with its mantle surface, to the clear cross-section or at least to the holding segment. For example, it would be conceivable that the clear cross-section or the holding segment has a specific sequence of preferably small steps for narrowing, and that the mantle surface has a sequence of steps corresponding to these.

According to what has been stated above, the sleeve element and the inner element are designed in such a manner that in the operating state, the inner element and the sleeve element can be rotated relative to one another about the longitudinal axis of the sleeve element and/or the longitudinal axis of the inner element. Concomitantly, the at least section-wise arrangement of the inner element in the holding segment is such that a gap having a specific gap width occurs between the mantle surface and the inside wall that delimits the clear cross-section and thereby, in particular, the holding segment. Accordingly, lubricant from a lubricant sump of the coolant compressor can enter into this gap when the inner element and the sleeve element project into the lubricant sump, at least in certain areas. In this regard, the sleeve element projects into the lubricant sump in the region of its lower end, in particular, and the inner element projects into it in the region of the lower end of its mantle surface, in particular.

The lubricant can be, in particular, an oil that is common for use in coolant compressors.

Relative rotation of the sleeve element and of the inner element relative to one another is brought about by means of rotation of the crankshaft, in particular in the case of a torque-proof connection of the sleeve element with the crankshaft.

Preferably, in this regard the inner element does not rotate relative to the stator or rotates only about a restricted angle range, whereas the sleeve element rotates completely. As has already been stated above, however, a reverse design is also possible, in which the inner element rotates completely, and the sleeve element does not rotate relative to the stator or rotates only about a restricted angle range.

Due to the viscosity of the lubricant or the friction between lubricant and sleeve element or inner element, a corresponding centrifugal force acts on the lubricant. This force presses the lubricant in the gap in the direction from the lower end to the upper end of the mantle surface, and thereby in the direction of the crankshaft. Due to the narrowing of the inner element or of the holding segment, the latter can have a large diameter in the region of the lower end of the mantle surface, and thereby great tangential speeds or centrifugal forces are achieved even at low speeds of rotation, so as to guarantee reliable conveying of lubricant. On the other hand, it can be ensured, by means of the narrowing of the inner element or of the holding segment, that an essentially continuous transition, i.e. a transition without an abrupt pressure drop, takes place for the lubricant from the gap into a bore of the crankshaft, in the region of the upper end of the mantle surface. Accordingly, disadvantageous reduction of the lubricant flow can be prevented.

In order to further improve conveying of the lubricant, it is provided that the inside wall and/or the mantle surface has at least one groove that runs in spiral shape. In other words the inside wall and/or the mantle surface can also have multiple grooves.

The at least one groove makes an additional conveying volume available for the lubricant, next to the gap, which volume is independent of the gap width. Because of the centrifugal forces that act on the lubricant, the lubricant is pressed into and through the at least one groove.

Preferably, the mantle surface has the at least one spiral-shaped groove, which runs in the direction from the lower end to the upper end of the mantle surface. In this regard, the at least one groove can extend from the lower end to the upper end of the mantle surface. However, theoretically it can also begin only in the region of the lower end, for example, and/or can stop in the region of the upper end, so that a certain excess length of the mantle surface over the groove exists in the region of the lower and/or upper end. Viewed in the direction of the longitudinal axis of the inner element, the at least one groove runs in spiral shape about this longitudinal axis, wherein the groove could theoretically also end on the longitudinal axis. For the sake of good order, it is being stated that the progression of the groove can also be in the reverse direction, i.e. from the upper end to the lower end of the mantle surface.

In order to optimize the lubricant flow, in particular with regard to its stability or continuity, it is provided, in the case of the lubricant holder according to the invention, that the at least one groove has a varying angle of inclination, which preferably increases from the lower end to the upper end of the mantle surface.

In a preferred embodiment of the lubricant holder according to the invention, it is provided that the clear cross-section of the sleeve element is configured in the form of a truncated cone, at least in its holding segment. This proves to be advantageous in terms of production technology, for one thing. On the other hand, this also has an advantageous effect on the flow behavior of the lubricant or oil, since a correspondingly smooth inside wall is present, at least in the holding segment.

If the inside wall has the at least one groove, what the above statement means, of course, is that the clear cross-section of the sleeve element is formed in the shape of a truncated cone in its holding segment, with the exception of the at least one groove.

In a preferred embodiment of the lubricant holder according to the invention, it is provided that the mantle surface of the inner element is configured as the mantle surface of a truncated cone. Once again, this proves to be advantageous in terms of production technology, on the one hand. On the other hand, this also has an advantageous effect on the flow behavior of the lubricant or oil, since a smooth mantle surface exists.

If the mantle surface has the at least one groove, what the above statement means, of course, is that the mantle surface is formed as the mantle surface of a truncated cone, with the exception of the at least one groove.

In this regard, particularly advantageous flow conditions exist if at least the holding segment is configured in the shape of a truncated cone, in particular if a design that corresponds to the mantle surface is undertaken in this regard. Accordingly, it is provided, in the case of a particularly preferred embodiment of the lubricant holder according to the invention, that the truncated cone shape of the holding segment of the clear cross-section is based on a cone having a first opening angle, that the truncated cone shape, according to which the mantle surface is configured, is based on a cone having a second opening angle, and that the absolute difference between the first opening angle and the second opening angle is less than or equal to 10°, preferably less than or equal to 5°, particularly preferably less than 0°. In this regard, the absolute difference is understood to be the absolute amount of the difference between the two opening angles.

In a preferred embodiment of the lubricant holder according to the invention, it is provided that the inner element has at least one projecting wing and/or a fastening element, preferably an eye, for a fixation means in the region of the lower end of the mantle surface. This embodiment serves for the purpose of causing the inner element not to turn at all or to turn maximally only by a specific angle amount during rotation of the crankshaft, whereas the sleeve element rotates with the crankshaft. For this purpose, the wing, which dips into the lubricant sump, can be sufficient due to the viscosity of the lubricant, i.e. the lubricant brings about sufficiently great resistance to rotation of the inner element. To increase this resistance, the surface of the wing can be structured to be correspondingly greater. Typically, the at least one wing does not project away from the mantle surface, but rather from a type of base surface of the inner element, which stands essentially normal to the longitudinal axis of the inner element. In particular, the at least one wing extends parallel, at least in certain areas—as well as normal to the longitudinal axis, and faces away from the upper end of the mantle surface in this regard.

Alternatively or in addition, a fixation means, for example in the form of a bracket or a mounting, can be provided, which means is fastened to the fastening element, on the one hand, and is supported on or rigidly connected with an essentially immovable element, for example on the stator, on the other hand.

The fixation means can also serve to support the inner element with reference to the longitudinal axis, i.e. with a direction component parallel to the longitudinal axis, of the sleeve element, in fixed or movable manner. Alternatively or in addition, the buoyancy that the inner element experiences when it dips into the lubricant sump can be utilized for the purpose of such support. In particular, in this regard the inner element can be designed in such a manner that it floats on the lubricant (in other words does not go under completely), and this represents particularly cost-advantageous support of the inner element. Accordingly, it is provided, in the case of a preferred embodiment of the lubricant holder according to the invention, that the inner element is produced from a material, preferably a plastic, having a density that is less than the density of the lubricant. Production of the inner element from a light metal or a light metal alloy, in particular an aluminum alloy, would also be conceivable in this regard, so as to achieve the desired density.

Analogous to what has been stated above, it is provided, according to the invention, in the case of a coolant compressor having a compressor housing that can be hermetically encapsulated, an electrical drive unit arranged in a housing interior of the compressor housing, comprising a rotor and a stator, a crankshaft connected with the rotor in torque-proof manner, as well as a piston/cylinder unit arranged in the housing interior, which unit comprises a piston movably mounted in a cylinder of the piston/cylinder unit, which piston can be driven by the crankshaft for compression of coolant, that the coolant compressor has a lubricant holder according to the invention that is in the operating state, so as to convey lubricant out of a lubricant sump formed in a bottom region of the compressor housing, by way of the crankshaft.

As has also been explained above, the inner element or the sleeve element can be connected with the crankshaft in torque-proof manner. Accordingly, it is provided, in the case of a preferred embodiment of the coolant compressor according to the invention, that the sleeve element of the lubricant holder is connected with the crankshaft in torque-proof manner.

In a preferred embodiment of the coolant compressor according to the invention, it is provided that the crankshaft has a bore, which bore preferably that runs at a slant to an axis of rotation of the crankshaft at least in certain areas, which bore stands in a fluidic connection with the clear cross-section of the sleeve element, wherein the inner element projects into the bore. This arrangement is possible due to the narrowing of the inner element, and guarantees a particularly good transition for the lubricant from the gap into the bore of the crankshaft. By way of at least one exit bore, the lubricant can then exit from the crankshaft more precisely, from the bore of the crankshaft to locations that are to be lubricated. Preferably, multiple exit bores are provided, which are arranged one behind the other viewed along the axis of rotation of the crankshaft.

According to what has furthermore already been stated above, it is provided, in the case of a preferred embodiment of the coolant compressor according to the invention, that the inner element is movable with reference to the longitudinal axis of the sleeve element. The gap width is changed by means of a corresponding movement of the inner element parallel to the longitudinal axis of the sleeve element. Accordingly, the gap width can be adapted to operating parameters such as the temperature and/or the viscosity of the lubricant and/or the speed of rotation, for example, so as to allow optimal lubricant flow. For example, the gap width can be reduced in the case of a lubricant that is becoming thinner, so as to bring about increased conveying.

In particular, such adjustment or regulation of the gap width can take place automatically or on its own, in simple manner. For this purpose, it is provided, in the case of a preferred embodiment of the coolant compressor according to the invention, that a fixation means configured as a spring element, preferably in the form of a resilient wire bracket, is provided, with which element the inner element is connected with the stator or other components of the coolant compressor essentially in torque-proof manner. As has already been described, slight angles of twist of the inner element, which might occur due to the elasticity of the spring element, can be tolerated.

The connection with the stator or other components—essentially immovable components—of the coolant compressor can exist directly or indirectly, i.e. with the intermediary of further elements.

The spring element ensures, in particular, a certain mobility of the inner element parallel to the longitudinal axis of the sleeve element. In this regard, the spring element brings about the result that the inner element is pressed in the direction of the holding segment, up to a certain degree, and this tendentially leads to a reduction in the gap width. A certain pressure of the lubricant in the gap counteracts this; this pressure is dependent on various factors. For example, the inner element is pressed away from the inside wall of the holding segment, counter to the spring force of the spring element, all the more the more viscous the lubricant is or the greater the speed of rotation is, and the gap width remains all the greater. If the lubricant becomes thinner or if the speed of rotation decreases, the inner element is pressed away from the inside wall of the holding segment less strongly, counter to the force of the spring element, by means of the lubricant flowing through the gap, and the gap width decreases accordingly.

Alternatively, the adjustment can also take place—at least roughly—with utilization of the buoyancy of the inner element in the lubricant as described above, wherein if the at least one wing is present, it is also possible to do without the fixation means entirely. Due to the buoyancy, the inner element is fundamentally pressed in the direction of the holding segment, and this tendentially leads to a reduction in the gap width—analogous to the embodiment having a spring element, as described above. This is counteracted by the pressure of the lubricant in the gap, which pressure is dependent on various factors. For example, the gap width becomes all the greater, the more viscous the lubricant is or the greater the speed of rotation is. If the lubricant becomes thinner or if the speed of rotation decreases, the gap width decreases accordingly.

In particular, in the manner described, it is possible to automatically equalize variations in lubricant conveying due to variations in the speed of rotation. Such variations in the speed of rotation can occur, in particularly marked manner, in the case of compressors having a variable speed of rotation and very low inertia moments of crankshaft and rotor.

BRIEF DESCRIPTION OF THE FIGURES

The invention will now be explained in greater detail using an exemplary embodiment. The drawings are meant as examples and are supposed to explain the idea of the invention, but by no means to restrict it or to conclusively represent it.

In this regard, the figures show:

FIG. 1 an inner element of an embodiment of a lubricant holder according to the invention, in an axonometric view, FIG. 2 a sectional view of the embodiment of the lubricant holder according to the invention, wherein the lubricant holder is mounted on a crankshaft of a coolant compressor according to the invention, FIG. 3 a sectional view of a coolant compressor according to the invention, with the lubricant holder from FIG. 2.

WAYS TO IMPLEMENT THE INVENTION

Figure 3:
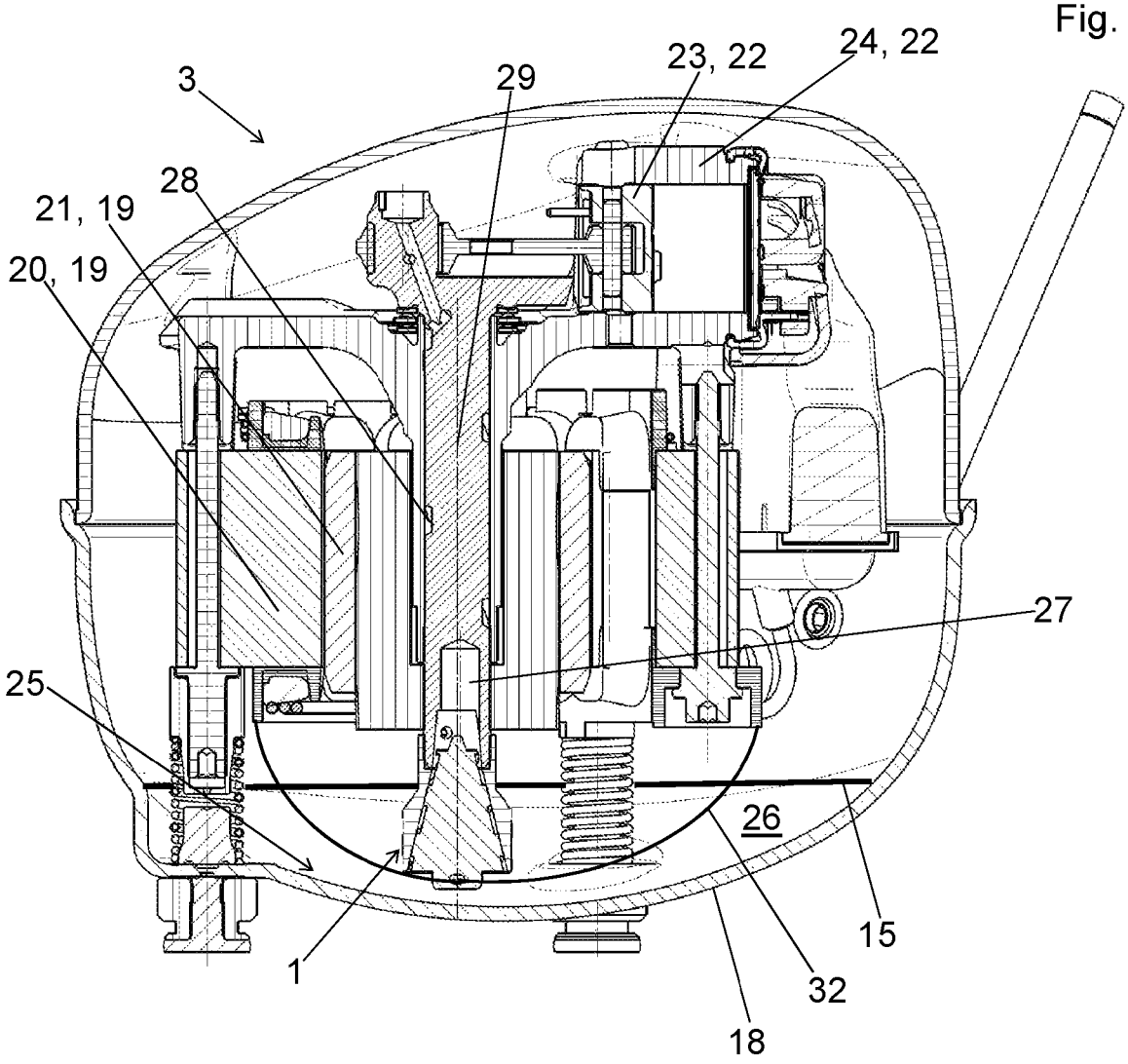

FIG. 1 shows an axonometric view of an inner element 9 of a lubricant holder 1 according to the invention. The latter is shown in an operating state and fastened to a crankshaft 2 of a coolant compressor 3 according to the invention in FIG. 2, in a sectional view.

The lubricant holder 1 serves for vertical conveying of lubricant, in particular oil 15, from a lubricant sump 26 formed in a bottom region 25 of a compressor housing 18 of the coolant compressor 3, see also the sectional view of FIG. 3, by way of the crankshaft 2. For this purpose, the crankshaft 2 has a bore 27 that can be seen well in FIG. 2, from which bore the oil 15 can exit to locations to be lubricated, by way of exit bores 28. For optimal conveying of the oil 15, the bore 27 can be structured to run at a slant to an axis of rotation 29 of the crankshaft 2, as shown in FIG. 2.

Furthermore, an electrical drive unit 19 having a rotor 20 and a stator 21 is arranged in the compressor housing 18, wherein the crankshaft 2 is connected with the rotor 20 in torque-proof manner. Furthermore, a piston/cylinder unit 22 is situated in the compressor housing 18, which unit comprises a piston 23 mounted so as to move in a cylinder 24 of the piston/cylinder unit 22, which piston can be driven by the crankshaft 2 for compression of coolant.

The lubricant holder 1 comprises a sleeve element 4 having a clear cross-section 5 delimited by an inside wall 34, which cross-section extends along a longitudinal axis 6 of the sleeve element 4, from an upper end 7 to a lower end 8 of the sleeve element 4. As can be seen in FIG. 2, the clear cross-section 5 can serve to hold the crankshaft 2 at the upper end 7, for example so as to produce a torque-proof connection between the sleeve element 4 and thereby the lubricant holder 1 and the crankshaft 2, for example by means of a press fit.

Fundamentally, however, lubricant holders 1 according to the invention are also possible, in which a torque-proof connection of the lubricant holder 1 with the crankshaft 2 takes place by way of a torque-proof connection between the inner element 9 and the crankshaft 2.

Furthermore, the lubricant holder 1 comprises the inner element 9, which has a mantle surface 10 that extends along a longitudinal axis 11 of the inner element 9, from a lower end 12 to an upper end 13, and has a groove 14 in the exemplary embodiment shown. This groove 14 runs in spiral shape, in the direction from the lower end 12 to the upper end 13, and extends from the lower end 12 to the upper end 13 of the mantle surface 10. According to the invention, the groove 14 has a varying inclination angle, which preferably increases from the lower end 12 to the upper end 13 of the mantle surface 10. In the exemplary embodiment shown, the inside wall 34 does not have a groove, although this is fundamentally possible.

In the operating state of the lubricant holder 1, the inner element 9 is arranged, with its mantle surface 10, at least in certain areas—in the exemplary embodiment shown, essentially completely—within the clear cross-section 5 of the sleeve element 4, more precisely in a holding segment 33 of the clear cross-section 5, intended for holding. In this regard, viewed in the direction from the lower end 8 to the upper end 9 of the sleeve element 4, the lower end 12 of the mantle surface 10 is arranged in front of its upper ends 13, in other words the sleeve element 4 and the inner element 9 are oriented or aligned in the same way, as it were. Furthermore, the sleeve element 4 and the inner element 9 are designed in such a manner that the inner element 9 and the sleeve element 4 can be rotated relative to one another about the longitudinal axis 6 of the sleeve element 4 and/or the longitudinal axis 11 of the inner element 9. This rotation is imparted or produced, during operation of the coolant compressor, by means of the torque-proof connection of the lubricant holder 1 with the crankshaft 2. Fundamentally, the only important thing is the relative rotation between the sleeve element 4 and the inner element 9, in other words it would be conceivable that the inner element 9 is driven to rotate and the sleeve element 4 is essentially fixed in place rotationally. In the exemplary embodiment shown, the sleeve element 4 is driven to rotate due to the torque-proof connection of the sleeve element 4 with the crankshaft 2 when the crankshaft 2 rotates, but the inner element 9 is not.

In order to prevent rotational movements of the inner element 9 to a great extent, this element can be connected with the stator 21, for example, by means of a fixation means. For this purpose, the inner element 9 can have a fastening element in the form of an eye 16, with which the fixation means can be brought into engagement, as shown in FIG. 1.

As is evident from FIG. 2, for example, a gap 30 having a gap width 31 between the mantle surface 10 and the inside wall 34 occurs in the operating state, i.e. in the case of placement of the inner element 9 in the sleeve element 4; the inside wall delimits the clear cross-section 5 and thereby, in particular, the holding segment 33. Accordingly, the oil 15 can enter into this gap 30 from the lubricant sump 26 when the inner element 9 and the sleeve element 4 project into the lubricant sump 26 at least in certain areas. In this regard, the sleeve element 4 projects into the lubricant sump 26 in the region of its lower end 8, in particular, and the inner element 9 projects into it in the region of the lower end 12 of its mantle surface 10, in particular. Due to the viscosity of the oil 15 or the friction between the oil 15 and the sleeve element 4, a corresponding centrifugal force acts on the oil 15 when the sleeve element 4 rotates. This force presses the oil 15 in the gap 30 and, in particular, in the at least one groove 14 in the direction from the lower end 12 to the upper end 13 of the mantle surface 10, and thereby in the direction of the crankshaft 2.

In each case, the oil 15 can flow particularly well in the direction of the crankshaft 2 by way of the groove 14—independent of the precise gap width 31. In the exemplary embodiment shown, the bore 27 of the crankshaft 2 stands in a fluidic connection with the clear cross-section 5 and thereby, in particular, also with the groove 14, so that the oil 15 can get all the way into the bore 27.

On the one hand, the clear cross-section 5 narrows, according to the invention, at least in the holding segment 33, in the direction from the lower end 8 to the upper end 7. On the other hand, according to the invention the inner element 9 narrows in the region of the mantle surface 10, in the direction from the lower end 12 to the upper end 13 of the mantle surface 10. Due to the narrowing of the inner element 9 or of the holding segment 33, the latter can have a large diameter in the region of the lower end 12 of the mantle surface 10, and thereby sufficiently great tangential speeds or centrifugal forces (in the gap 30) are implemented even at low speeds of rotation, so as to guarantee reliable conveying of the oil 15.

On the other hand, it can be ensured, by means of the narrowing of the inner element 9 or of the holding segment 33, that an essentially continuous transition, i.e. a transition without an abrupt pressure drop, occurs for the oil 15 from the gap 30 into the bore 27 of the crankshaft 2 in the region of the upper end of the mantle surface 10. In the exemplary embodiment shown, this continuous transition is further improved in that the inner element 9 with its narrowing is designed in such a manner that the inner element 9 projects into the bore 27, see FIG. 2. Accordingly, disadvantageous reduction of the lubricant flow can be prevented practically entirely.

The shape of the narrowing of the clear cross-section 5 in the holding segment 33, on the one hand, and the shape of the narrowing of the inner element 9 in the region of the mantle surface 10, on the other hand, are coordinated with one another, in the exemplary embodiment shown, so as to allow optimal placement of the inner element 9 in the sleeve element 4 in the operating state. For this purpose, the clear cross-section 5 of the sleeve element 4 is configured in the form of a truncated cone, at least in its holding segment 33, on the one hand, wherein this truncated-cone shape is based on a cone having a first opening angle θ1. On the other hand, the mantle surface 10 of the inner element 9, with the exception of the at least one groove 14, is configured as the mantle surface of a truncated cone, wherein this truncated-cone shape is based on a cone having a second opening angle θ2. The coordination mentioned above is further optimized, in the case of the exemplary embodiment shown, in that the absolute amount of the difference between the first opening angle θ1 and the second opening angle θ2 is less than or equal to 10°, preferably less than or equal to 5°, particularly preferably equal to 0°.

In the exemplary embodiment shown, it is furthermore provided that the inner element 9, with reference to the longitudinal axis 6 of the sleeve element 4, i.e. with a direction component parallel to the longitudinal axis 6, is mounted in movable manner. In interplay with the narrowing holding segment 33 and the narrowing inner element 9, the gap width 31 can be fundamentally adjusted in this way, in particular for adaptation to operating parameters such as, for example, the temperature and/or the viscosity of the oil 15 and/or the speed of rotation, so as to allow an optimal lubricant flow. For example, the gap width 31 could be reduced in the case of an oil 15 that becomes thinner, so as to bring about increased conveying. The adjustment possibility is particularly precise in the case of the exemplary embodiment shown, due to the aforementioned truncated-cone shapes.

In concrete terms, in the embodiment shown automatic adjustment is actually provided. According to FIG. 3, the fixation means is formed, for this purpose, as a spring element in the form of a resilient wire bracket 32, with which the inner element 9 is connected with the stator 21 in essentially torque-proof manner. Slight angles of twist of the inner element 9, which might occur as the result of the elasticity of the resilient wire bracket 32, can be tolerated in this regard. In any case, the resilient wire bracket 32 brings about the result that the inner element 9 is pressed in the direction of the holding segment 33 up to a certain degree, and this tends to reduce the gap width 31. A certain pressure of the oil 15 in the gap 30 counteracts this; this pressure depends on various factors. For example, the inner element 9 is pressed away from the inside wall 34 of the holding segment 33, counter to the spring force of the resilient wire bracket 32, all the more strongly, the more viscous the oil 15 is or the greater the speed of rotation is, and the gap width 31 remains all the greater. If the oil 15 becomes thinner or if the speed of rotation drops, the inner element 9 is pressed away from the inside wall of the holding segment 33, counter to the spring force of the resilient wire bracket 32, all the less strongly, by the oil 15 that flows in the gap 30, and the gap width 31 is reduced accordingly.

REFERENCE SYMBOL LIST

1 lubricant holder
2 crankshaft
3 coolant compressor
4 sleeve element
5 clear cross-section of the sleeve element
6 longitudinal axis of the sleeve element
7 upper end of the sleeve element
8 lower end of the sleeve element
9 inner element
10 mantle surface of the inner element
11 longitudinal axis of the inner element
12 lower end of the mantle surface
13 upper end of the mantle surface
14 groove
15 oil
16 eye
18 compressor housing
19 electrical drive unit
20 rotor
21 stator
22 piston/cylinder unit
23 piston
24 cylinder
25 bottom region
26 lubricant sump
27 bore of the crankshaft
28 exit bore
29 axis of rotation of the crankshaft
30 gap
31 gap width
32 resilient wire bracket
33 holding segment of the clear cross-section
34 inside wall
θ1 first opening angle
θ2 second opening angle

The invention claimed is:

1. A lubricant holder for vertical conveying of lubricant by means of a crankshaft of a coolant compressor, comprising a sleeve element having a clear cross-section delimited by an inside wall, which clear cross-section extends along a longitudinal axis of the sleeve element, from an upper end to a lower end of the sleeve element, the lubricant holder furthermore comprising an inner element that has a mantle surface that extends along a longitudinal axis of the inner element, from a lower end to an upper end, wherein in an operating state of the lubricant holder the inner element is arranged within the clear cross-section of the sleeve element with its mantle surface, at least in certain areas, viewed in the direction from the lower end to the upper end of the sleeve element, the lower end of the mantle surface is disposed in front of its upper end, and the inner element and the sleeve element can be rotated relative to one another about the longitudinal axis of the sleeve element and/or the longitudinal axis of the inner element, wherein the clear cross-section narrows from the lower end to the upper end of the sleeve element, at least in a holding segment intended for holding the inner element, wherein the inner element narrows in the region of the mantle surface, from the lower end to the upper end of the mantle surface, and wherein the inside wall and/or the mantle surface has/have at least one groove that runs in spiral shape, wherein the at least one groove has a varying angle of inclination.

2. The lubricant holder according to claim 1, wherein the clear cross-section of the sleeve element is configured in the form of a truncated cone, at least in its holding segment.

3. The lubricant holder according to claim 2, wherein the truncated-cone shape of the holding segment of the clear cross-section is based on a first cone having a first opening angle, wherein the mantle surface of the inner element is configured as the mantle surface of a truncated cone based on a second cone having a second opening angle, and wherein the absolute difference between the first opening angle and the second opening angle is less than or equal to 10°.

4. The lubricant holder according to claim 1, wherein the mantle surface of the inner element is configured as the mantle surface of a truncated cone.

5. The lubricant holder according to claim 1, wherein the inner element has at least one projecting wing and/or a fastening element for a fixation means, in the region of the lower end of the mantle surface.

6. The lubricant holder according to claim 1, wherein the inner element is produced from a material having a density that is less than the density of the lubricant.

7. A coolant compressor having a compressor housing that can be hermetically encapsulated, an electrical drive unit arranged in a housing interior of the compressor housing, comprising a rotor and a stator, a crankshaft connected with the rotor in torque-proof manner, as well as a piston/cylinder unit arranged in the housing interior, which unit comprises a piston movably mounted in a cylinder of the piston/cylinder unit, which piston can be driven by the crankshaft for compression of coolant, wherein the coolant compressor has the lubricant holder according to claim 1 that is in the operating state, so as to convey lubricant out of a lubricant sump formed in a bottom region of the compressor housing, by way of the crankshaft.

8. The coolant compressor according to claim 7, wherein the sleeve element of the lubricant holder is connected with the crankshaft in torque-proof manner.

9. The coolant compressor according to claim 7, wherein the crankshaft has a bore, which bore stands in a fluidic connection with the clear cross-section of the sleeve element, wherein the inner element projects into the bore.

10. The coolant compressor according to claim 7, wherein the inner element can be moved with reference to the longitudinal axis of the sleeve element.

11. The coolant compressor according to claim 7, wherein a fixation means configured as a spring element is provided, with which the inner element is connected with the stator or other components of the coolant compressor, essentially in torque-proof manner.

12. The lubricant holder according to claim 1, wherein the at least one groove has a varying angle of inclination, which increases from the lower end to the upper end of the mantle surface.

* * * * *